United States Patent [19]

Fincham et al.

[11] Patent Number: 4,733,477

[45] Date of Patent: Mar. 29, 1988

[54] CHALK LINE FRAMING SQUARE

[76] Inventors: James R. Fincham, 11509 February Cir., Silver Spring, Md. 20904; George Spector, 233 Broadway, Rm. 3815, New York, N.Y. 10007

[21] Appl. No.: 26,778

[22] Filed: Mar. 17, 1987

[51] Int. Cl.[4] ..... B43L 7/00; B43L 13/00

[52] U.S. Cl. ..... 33/451; 33/471; 33/478; 33/527; 33/DIG. 20

[58] Field of Search ..... 33/451, 465, 471, 474, 33/476, 477, 478, 480, 492, 527, DIG. 20

[56] References Cited

U.S. PATENT DOCUMENTS

| | | | |
|---|---|---|---|
| 245,844 | 8/1881 | Low | 33/474 |
| 1,549,151 | 8/1925 | Rasmussen | 33/478 |
| 1,643,695 | 9/1927 | Bunger | 33/476 |
| 2,642,674 | 6/1953 | Schell, Jr. | 33/527 |
| 2,741,030 | 4/1956 | Wise | 33/451 |
| 2,770,043 | 11/1956 | Kwiecinski | 33/DIG. 20 |
| 2,883,753 | 4/1959 | Schoenmaker | 33/476 |
| 2,939,219 | 6/1960 | Georges | 33/492 |
| 3,154,861 | 11/1964 | Rubenstein | 33/492 |

*Primary Examiner*—Richard R. Stearns

[57] ABSTRACT

A chalk line framing square is provided to aid in placing right angle intersecting chalk lines upon a floor so that tiles can be properly installed on the floor. The framing square can check the squareness of the tiles as they are installed without being placed in the adhesive.

4 Claims, 4 Drawing Figures

CHALK LINE FRAMING SQUARE

BACKGROUND OF THE INVENTION

The instant invention relates generally to guide tools and more specifically it relates to a chalk line framing square.

Numerous guide tools have been provided in prior art that are adapted to contain notches thereon to measure various sized items. For example, U.S. Pat. Nos. 848,399; 1,553,229 and 3,797,122 all are illustrative of such prior art. While these units may be suitable for the particular purpose to which they address, they would not be as suitable for the purposes of the present invention as heretofore described.

SUMMARY OF THE INVENTION

A primary object of the present invention is to provide a chalk line framing square that will overcome the shortcomings of the prior art devices.

Another object is to provide a chalk line framing square that is so designed to aid in placing right angle intersecting chalk lines upon a floor so that tiles can be properly installed on the floor.

An additional object is to provide a chalk line framing square that is so designed to check the squareness of the tiles as they are installed with adhesive without placing the tool in the adhesive.

A further object is to provide a chalk line framing square that is simple and easy to use.

A still further object is to provide a chalk line framing square that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
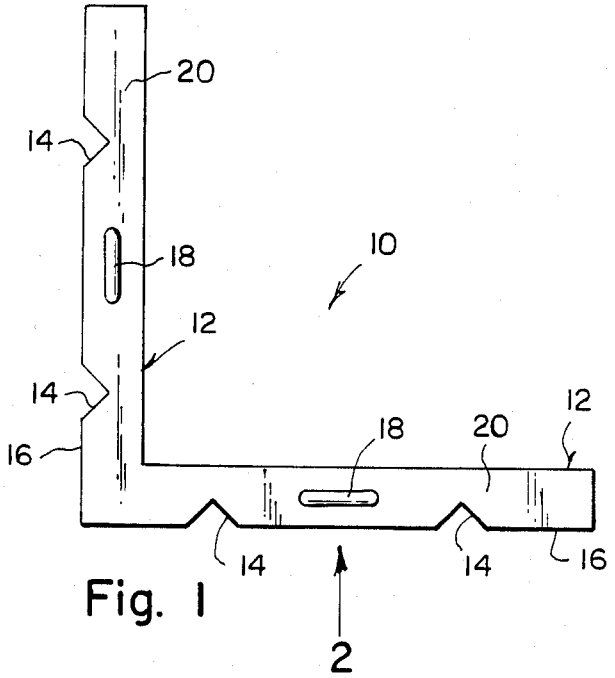
FIG. 1 is a top plan view of the invention.
Figure 2:
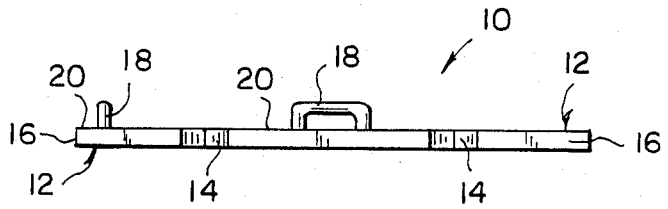
FIG. 2 is a side view taken in direction of arrow 2 in FIG. 1.

Turning now descriptively to the drawings, in which similar reference characters denote similar elements throughout the several views, FIGS. 1 and 2 illustrate a chalk line framing square 10 for a floor having tiles installed thereon with adhesive. The framing square 10 consists of a pair of arms 12 at right angles. Each of the arms 12 have a pair of spaced apart notches 14 that are V-shaped and formed on outer edge 16 thereof to act as view points for enabling visual alignment of the arms 12 for laying out right angle intersecting chalk lines upon the floor, so that the tiles can be properly installed with the adhesive to the floor.

A pair of handles 18 are also provided. Each of the handles 18 is affixed to top 20 of each of the arms 12 to allow a person to hold the framing square 10 to check squareness of the tiles without laying the framing square in the adhesive.

Figure 3:
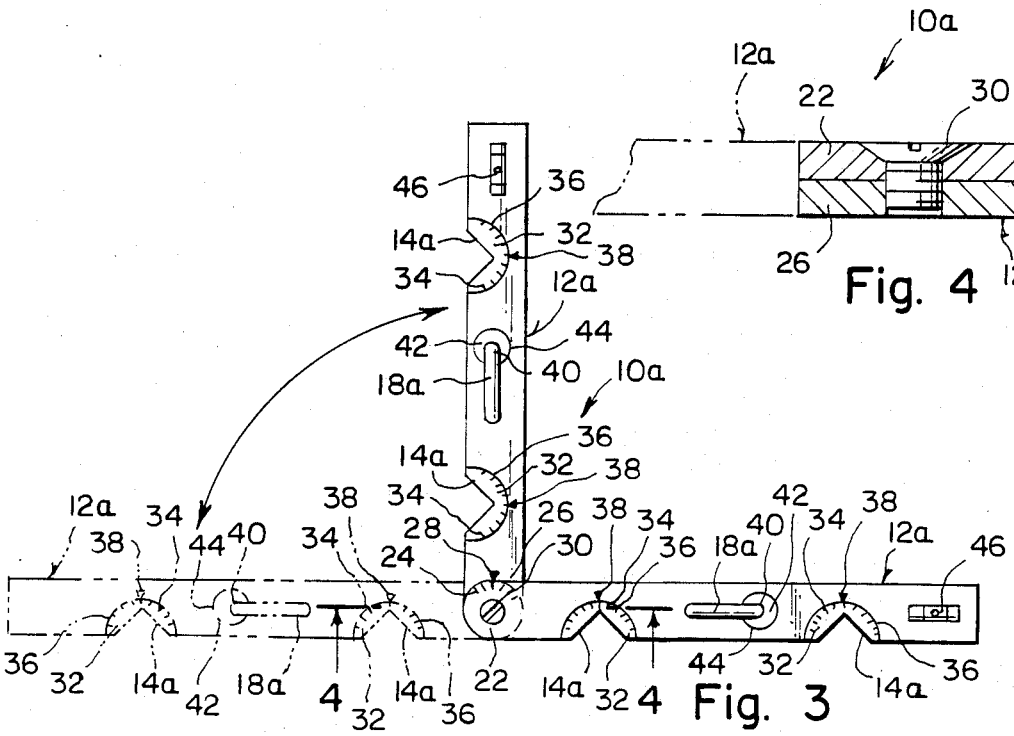
FIG. 3 is a top plan view of a modification showing an adjustable framing square to change angles of arms thereof.
Figure 4:
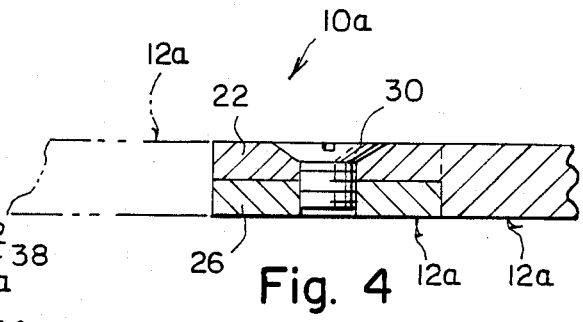
FIG. 4 is an enlarged cross sectional view taken along line 4—4 in FIG. 3 showing the pivot with set screw in greater detail.

FIGS. 3 and 4 show a modified chalk line framing square **10*a* wherein the arms 12*a*, the notches 14*a* and the handles 18*a* are pivotly adjustable for laying out chalk lines so that walls in a building can be installed, since many walls are not built at right angles. One arm 12*a* has a pivotable end portion 22 with degree markings 24 thereon. Other arm 12*a* has a pivotable end portion 26 with a pointer 28 thereon. The pivotable end portion 26 is in an overlap flush relationship with pivotable end portion 22 of the first arm 12*a*. A set screw 30 extends through the end portions 22, 26 of the arms 12*a*** so as to lock the arms in any desired angle needed.

Each of the notches **14*a* is in a curved portion 32 with degree markings 34 thereon, within each of the arms 12*a* having a curved cut out portion 36 with a pointer 38 thereon. The notches 14*a* can be turned to same angle as the arms 12*a*. Each of the handles 18*a* is affixed at one end 40 to a circular portion 42 within each of the arms 12*a* having a circular hole 44. The handles 18*a* can be turned to properly position the framing square 10*a* with respect to angle of the arms 12*a* and the notches 14*a*. The framing square 10*a* further contains a pair of level bubbles 46, each of which are affixed to top ends of each of the arms 12*a* to aid a person in keeping the framing square 10*a*** level when being used.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A chalk line framing square for a floor having tiles installed with adhesive thereon, said framing square comprising:

(a) a pair of arms at right angles, each of said arms having a pair of spaced apart notches that are V-shaped and formed on the outer edge thereof to act as view points for enabling visual alignment of said arms for laying out right angle intersecting chalk lines upon the floor so that the tiles can be properly installed with the adhesive to the floor; and (b) a pair of handles, each of said handles affixed to the top of each of said arms to allow a person to hold said framing square to check squareness of the tiles without laying said framing square in the adhesive, wherein said arms are pivotally adjustable, said handles are pivotally mounted and said notches are formed on members pivotally mounted on said arms for laying out chalk lines at varying angles.

2. A chalk line framing square as recited in claim 1, wherein said pivotally connected arms include means to indicate and retain said arms in various angular settings.

3. A chalk line framing square as recited in claim 2, wherein:

(c) each of said members is arcuate with degree markings thereon, and is mounted in an arcuate cut out portion with a pointer thereon so that said notches can be set at the desired angle; and (d) each of said handles have an end with a circular portion, each of said arms have a circular hole in which said circular portion is mounted pivotally for setting said arms at a desired angular position.

4. A chalk line framing square as recited in claim 3, further comprising a pair of level bubbles, each of which is affixed to one of said arms.

* * * * *